United States Patent [19]

Sameniego

[11] Patent Number: 4,858,801

[45] Date of Patent: Aug. 22, 1989

[54] GUITAR STRAP

[76] Inventor: Manuel Sameniego, 1026 Darwin Place, San Diego, Calif. 92154

[21] Appl. No.: 167,501

[22] Filed: Mar. 14, 1988

[51] Int. Cl.[4] ..... G10D 3/00

[52] U.S. Cl. ..... 224/264; 224/901; 224/910; 224/258; 224/205; 24/306; 84/327

[58] Field of Search ..... 224/150, 201, 202, 203, 224/205–208, 258, 257, 264, 265, 907–910, 916, 917, 901; 206/315.3, 316; 150/52 G, 52 T; 2/338, 267, 268, DIG. 6, DIG. 11, 2, 16; 24/306, 442; 128/DIG. 15, DIG. 26; 84/327

[56] References Cited

U.S. PATENT DOCUMENTS

| | | | |
|---|---|---|---|
| 2,551,255 | 5/1951 | Engel | 2/2 |
| 3,081,923 | 3/1963 | Bogby | 224/264 |
| 3,154,787 | 11/1964 | Newman | 2/2 |
| 3,323,698 | 6/1967 | Sottile | 224/910 |
| 3,882,914 | 5/1975 | Strutz | 206/315.3 |
| 3,935,782 | 2/1976 | O'brien | 224/910 |
| 4,148,423 | 4/1979 | Schlocker | 224/910 |
| 4,188,851 | 2/1980 | Wolf | 224/910 |
| 4,254,901 | 3/1981 | McIntosh | 224/910 |
| 4,373,213 | 2/1983 | Erlandson | 2/16 |
| 4,472,839 | 9/1984 | Johanson | 2/338 |
| 4,481,682 | 11/1984 | Hall | 2/DIG. 6 |
| 4,580,707 | 4/1986 | Shoemaker | 224/911 |
| 4,606,079 | 8/1986 | DeWoskin | 24/306 |
| 4,642,815 | 2/1987 | Allen | 2/2 |
| 4,764,962 | 8/1988 | Elman et al. | 224/901 |

FOREIGN PATENT DOCUMENTS

| | | | |
|---|---|---|---|
| 1263391 | 5/1961 | France | 128/DIG. 5 |

*Primary Examiner*—Harvey C. Hornsby
*Assistant Examiner*—Joseph S. Machuga
*Attorney, Agent, or Firm*—Nydegger & Harshman

[57] ABSTRACT

A guitar strap comprises a narrow band of flexible material having a top side and bottom side, with the bottom side having an anchor member located thereon. In addition, cushion means are provided having a coupling member connected thereto for detachably affixing the cushion means to the anchor member on the bottom side of the band. This permits the cushion member to be readily detachable from the band and makes the cushion member capable of being affixed onto the anchor member at differing desired positions laterally along the bottom side of the band. In addition, there is provided an end belt having a belt coupling member connected to one side thereof, the band further having an end portion defining a tunnel for slidably receiving the end belt and an anchor member located on an outer surface of the end portion for detachably affixing the end belt to the end anchor member after sliding the end belt through the tunnel. The anchor member and coupling members described are preferably hook and pile (or loop) fasteners.

12 Claims, 2 Drawing Sheets

GUITAR STRAP

BACKGROUND OF THE INVENTION

1. Field of the Invention

This invention relates to an improved guitar strap, and in particular to a guitar strap which is padded and easily adjustable in terms of location of the padding and overall length of the strap.

2. Description of the Prior Art

Conventional guitar straps as found in the prior art typically comprise a strap having a hole in one end, and a belt or other similar strap at the other end utilizing a buckle for adjusting the overall length of the strap. The straps are made out of many different materials, typically cloth, leather, and other flexible materials, and the like.

However, one problem with the prior art guitar straps is that a guitar or other musical instrument which is held on with a similar kind of strap may become heavy, and after long periods of use, the strap can cause pain and discomfort in the shoulder of the wearer of the strap. To overcome this problem, there have been devised straps which are wider in order to attempt to distribute the load over the shoulder. In addition, straps made of other material such as leather, rubber, and the like have been tried in order to overcome this problem. In addition, some padding extending the entire portion of the strap may possibly be utilized.

However, in practice, such devices have proved unworkable. In particular, the wider straps utilize such flexible, stretchable, or tickly padded material which may be costly, and often is bulky and cumbersome to work with. Thus, it is not readily acceptable to musicians as a viable alternative.

In addition, with respect to the mechanism for adjusting the overall length of the strap, conventional belt buckles with adjusting holes in the strap have been utilized. In addition, there are prior art rings which slide on the strap but which are difficult to adjust. However, belt buckle mechanisms do not allow a continuous form of adjustment, and the slidable ring types do not allow for quick and easy readjustment of the length of the strap as required for differing performances of differing musicians.

In addition, a guitar strap which is not conventional in its appearance is not desirable by musicians, typically. In addition, the wider straps which seek to spread the load out over the shoulder blade are also not desirable in that if they are too wide they may interfere with the ability of the musician to have mobility necessary and the aesthetically appealing width necessary and desirable for professional and other musician performances.

Moreover, devices in the prior art which attempt to maximize comfort to the user of the strap, have utilized materials which are relatively expensive to use and costly to manufacture, which have made such conventional guitar straps, not cost effective and not of desirable success.

This invention, therefore, provides a new and novel guitar strap which provides means for adjustably providing padded comfort to the wearer, as well as means for readily adjusting the length of the strap which has the effect of raising and lowering the musical instrument being played in a continuous adjustment fashion. Moreover, the strap is thoroughly adaptable to different shapes, the sizes of users, and can be sold at a moderate price.

SUMMARY OF THE INVENTION

It is an object of the present invention to provide an improved guitar strap.

It is another object of the present invention to provide a guitar strap which is adaptable to conform to the various sizes of the potential users, and in particular to provide a comfort level for the shoulder of the user thereof, while at the same time appearing as would a conventional strap.

It is further an object of the present invention to provide an improved strap which is inexpensive to manufacture and will make the use of the device easier, more efficient, and more effective than is heretofore known in the prior art.

It is yet another object of the present invention to provide a guitar strap which is simple in construction, economical, and will last for a long time.

It is yet another object of the present invention to provide a guitar strap being capable of being adjustable over a continuous length in terms of the length of the strap.

It is yet another object of the present invention to provide a guitar strap which can be made to fit the wearer thereof in a comfortable position suitably adapted to the particular user's requirements.

It is yet another object of the present invention to provide a guitar strap which looks like a conventional strap during use.

Further objects of the present invention will become apparent in the full description of the invention taken in conjunction with the drawings set forth below.

A guitar strap comprises a narrow band of flexible material having a top side and bottom side, with the bottom side having an anchor member located thereon. In addition, cushion means are provided having a coupling member connected thereto for detachably affixing the cushion means to the anchor member on the bottom side of the band. This permits the cushion member to be readily detachable from the band and makes the cushion member capable of being affixed onto the anchor member at differing desired positions laterally along the bottom side of the band. In addition, there is provided an end belt having a belt coupling member connected to one side thereof, with the band further having an end portion defining a tunnel for slidably receiving the end belt and an anchor member located on an outer surface of the end portion for detachably affixing the end belt to the end anchor member after sliding the end belt through the tunnel. The anchor member and coupling members described are preferably hook and pile (or loop) fasteners.

DETAILED DESCRIPTION OF THE DRAWINGS

Figure 1:
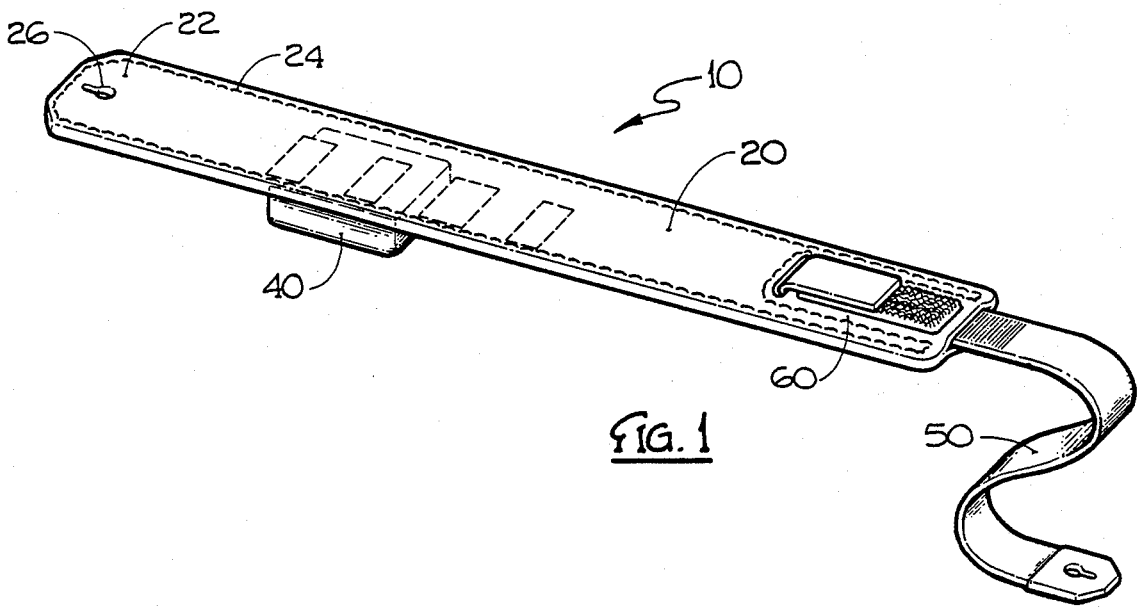
FIG. 1 is a diagrammatic plan view of a preferred embodiment of the guitar strap in accordance with the present invention.

In describing a preferred embodiment of the invention illustrated in the drawings, specific terminology will be resorted to for the sake of clarity. However, the invention is not intended to be limited to the specific terms so selected, and it is to be understood that each specific term includes all technical equivalents which operate in a similar manner to accomplish a similar purpose.

Referring to the drawings, in FIG. 1 there is a guitar strap 10. It comprises a narrow band of flexible material 20 which is used to drape over the shoulder of a user of the strap. The material is any suitable material which is comfortable to the user and readily conforms to the shape of the shoulder. A preferable material is a material similar to surgical strapping which has great strength and is of some thickness, approximately ⅛th inch thick. A preferable dimension for the band is approximately 3 inches wide by 33 inches long. This is a standard size to accommodate most individuals and instruments which might be played. The band 20 may be covered with a material 22 of appropriate design such as cloth or vinyl or other desired material giving the look and feel desired. This outer material is typically connected by means of stitching 24. In addition at one end of the band is an area defining a hole 26 through which the post at the top end of the guitar for holding the guitar may be inserted. As also further shown in FIGS. 2 and 3, the band 20 further includes at least one anchor member 28, and there is shown in the drawings a plurality of same located on the bottom side 32 of the band 20, namely, additional anchor members 29, 30 and 31. The anchor members 28, 29, 30, and 31 are preferably of the hook and pile fastener type of anchor members as further explained below.

Figure 4:
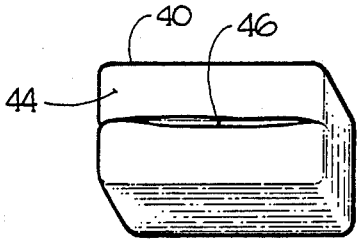
FIG. 4 is a diagrammatic plan view of the cushion means.
Figure 5:
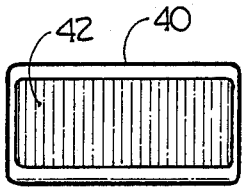
FIG. 5 is a bottom view of the cushion means shown in FIG. 4.
Figure 6:
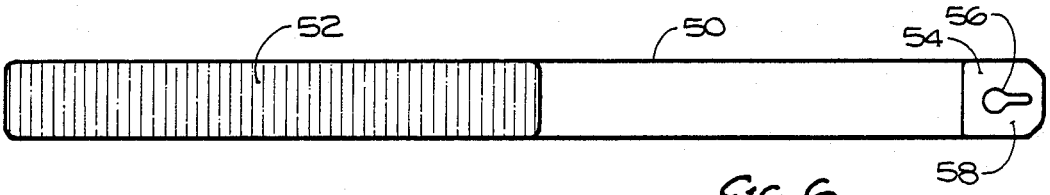
FIG. 6 is a top view of an end belt shown in FIG. 2.

There is shown in FIGS. 4 and 5 and FIG. 1 a cushion means 40 having a coupling member 42 attached to the bottom thereof. The cushion means is a member which provides cushioning or padding between the band and the shoulder of the wearer for providing added comfort. In the embodiment shown, the cushion means is a foam pad, but could be other suitable cushioning material, inserted into a generally rectangular cube-shaped casing 44. The casing is of a flexible material, and a preferable casing covering material is nylon material stitched to form the casing about the cushion pad. As shown in FIG. 4, there is shown a slit 46 into which the pad is inserted, which conveniently allows the pad to be removed so the item can be dry cleaned, if needed. On the bottom side of the cushion means is the coupling member 42 which is the mating section of the hook and fastener-type connecting member.

Figure 2:
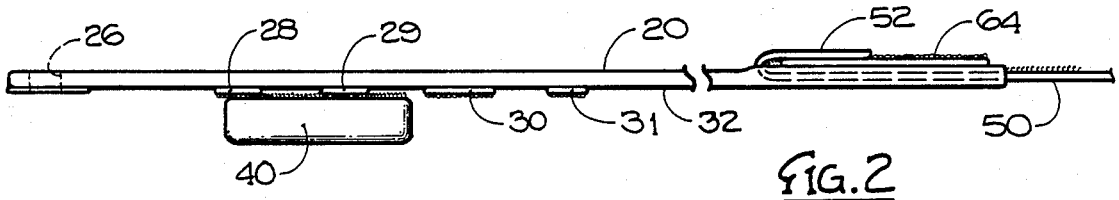
FIG. 2 is a side view of the device shown in FIG. 1.
Figure 3:
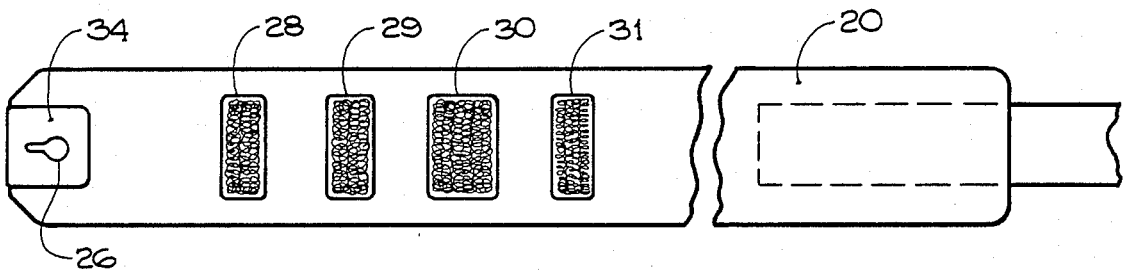
FIG. 3 is a bottom view of the device without cushion means.

As shown in FIG. 2, cushion means 40 having coupling member 42 on one surface thereof is then conveniently affixed to the band by means of one of anchor members 28, 29, 30, or 31. The type of hook and fastener coupling member which engages the anchor members is typically that in use known as VELCRO (VELCRO is a registered trademark) product or equivalent. In such a fashion, the cushion member is readily detachable from the band and is capable of being affixed onto the anchor members at different desired positions laterally along the bottom of the band.

The positioning of the anchor members 28, 29, 30, and 31 is such that the cushion means 40 may be positioned along a rather wide area to allow many different adjustment positions as desired. When in use, the cushion does not slip from its adjustment position because the cushion is held fast against the band. However, should the user desire to move it, he merely needs to detach or pull away the cushion and reattach it via the anchor members at a suitable spot, and once placed thereon, it does not move to new positions. An advantage of the present invention is that there is less material utilized and the user can adjust the cushion to whatever portion of the strap is required based on the size of the user and the particular instrument being played with the guitar strap.

It is further shown in FIG. 6, 7, 8, and 9, the configuration of an end belt 50 in conjunction with an end portion 60 of the band of material. In particular, there is shown an end belt 50 of flexible material typically of nylon webbing material or some other strong suitable material of a thickness narrower than that of the band. A preferable size for the end belt to be approximately 23 inches long by 1½ inches wide. One-half of the end belt is comprised of a coupling member 52 which is preferably a hook and fastener member such as the VELCRO mentioned above. At one end of the end belt is a portion 54 defining a hole 56 for affixing the opposite guitar holding post for holding the guitar on the guitar strap. There is also included leather reinforcing material 58 to assist in making sure the hole does not rip out due the excessive forces that may develop. In addition, a piece of leather reinforcement is included at the opposite hole as shown at 34 on FIG. 3.

Figure 7:
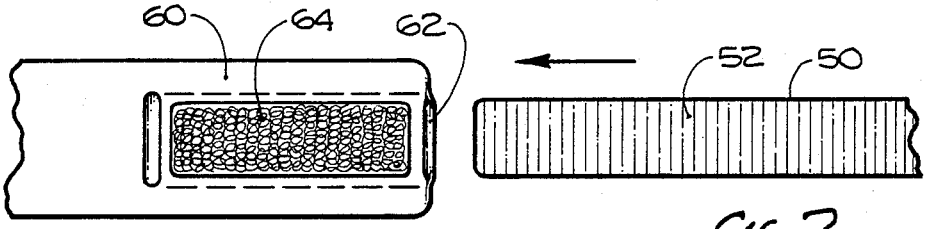
FIG. 7 is a diagrammatic plan view of an end belt being inserted into a portion of the device shown in FIG. 2.
Figure 8:
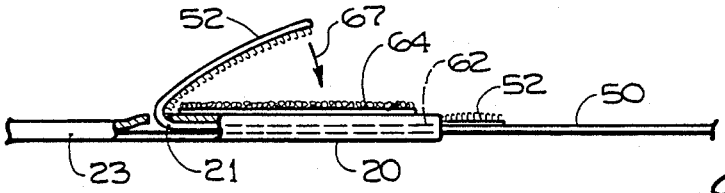
FIG. 8 is a side view, partially in cutaway view, showing operation of the connection of the end belt.
Figure 9:
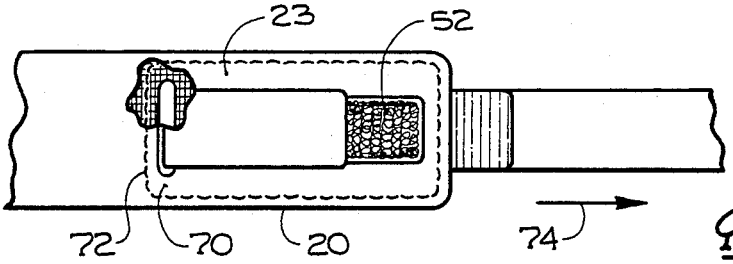
FIG. 9 is a top view, partially cutaway, showing a reinforcing member at one end of the end portion of the invention.

Further describing the end portion 60 there is shown in FIGS. 7 and 8 the end portion 60 defining a tunnel 62 into which there is inserted the coupling member portion 52 of end belt 50. In addition, on end portion 60 there is anchor member 64 covering the tunnel portion 60 in the form of a strip of hook and loop fastener, such as VELCRO stripping 64. It is attached by means of stitching or other suitable fashion to the top side of band 20. There is shown further that the band 20 in FIG. 8 may comprise flexible webbing 21, with nylon covering 23 thereon. As can be seen, the end belt is inserted through the tunnel portion, pulled through, and then folded back over and down as shown by the arrows 67 so that the end belt is then held fast in place as shown in FIG. 2 and FIG. 9. As further shown in FIG. 9, there is a reinforcing piece of material 70 such as leather which is stitched at 72 to band 20. This provides reinforcement so that when forces are pulling in the direction shown on arrow 74 in FIG. 9, the reinforcing strip bears the forces against the band, rather than having the end belt pull on the covering material 23.

The end belt can be inserted as far or pulled out as far as desired to adjust the length of the overall guitar strap, as long as a sufficient amount of the coupling member 52 connected to the end belt is looped back over on top of end portion anchor member 64 to provide firm holding power.

With respect to the size of anchor members 28, 29, 30, and 31, and their placement, it is preferred that the anchor members be of a size of approximately one inch wide, with spacing therebetween of approximately two and one-half inches. The anchor member 30 is of sufficient length, such as two inches rather than one inch, so that at any point due to the positioning and width of anchor members 28, 29, 30, and 31, when cushion means 40 is placed against the anchor members, the cushion means is held in at least two separate points or areas thereon to provide adequate holding power, such as that shown in FIG. 2. This results in a material savings. While the cushion member could be utilized and held with only one of the anchor means, it is found to be operable with better results when at least two of such anchor members are utilized. While it has been contemplated that one continuous member could be utilized, the present invention utilizes the spacing of separate members to realize cost savings in utilizing material, while still is able to adequately secure the cushion means for maximum flexibility and adaptability and comfort while providing a secure fixation of the cushion means to the band.

Although the present has been shown and described in terms of specific preferred embodiments, it will be appreciated by those skilled in the art that changes or modifications are possible which do not depart from the inventive concepts described and taught herein. Such changes and modifications are deemed to fall within the purview of these inventive concepts. Thus, it should be noted that the accompanying description and drawings are meant to describe the preferred embodiments of the invention, but are not intended to limit the spirit and scope thereof.

What is claimed is:

1. A guitar strap comprising:

a narrow band of flexible material having a top side and bottom side, said bottom side having a bottom anchor member located thereon;

cushion means having a cushion coupling member connected thereto for detachably affixing said cushion means to said anchor on the bottom side of said band;

so that said cushion member is readily detachable from said band and capable of being affixed onto said anchor member at differing desired positions laterally along said bottom side of said band; and an end belt having a belt coupling member connected to one side thereof;

said band further having an end portion defining a tunnel for slidably receiving said end belt, said end portion having an outer surface, and an end anchor member located on said outer surface of said end portion for detachably affixing said end belt to said end anchor member after sliding said end belt through said tunnel, and wherein said end portion includes a reinforcing member connected thereto so that said reinforcing member counteracts the force exerted by said end belt when said strap is in use.

2. The strap of claim 1, wherein said bottom anchor member further comprises a plurality of spaced apart bottom anchor members utilizing hook and pile fasteners.

3. The strap of claim, 2 wherein said bottom anchor members are spaced apart at a distance of approximately one-third the length of said cushion member.

4. The strap of claim 3, wherein there are four said bottom anchor members, and wherein three of said bottom anchor members are approximately of the same width and one bottom anchor member is approximately twice said width.

5. The strap of claim 2, wherein said cushion member is of a length of at least two of said bottom anchor members, and the space therebetween is of a sufficient amount so that said cushion member may be moved laterally along said bottom of said strap and have at least two separated points of affixation to said band.

6. The strap of claim 1 wherein said cushion member is foam rubber.

7. The strap of claim 6, wherein said cushion member is covered with nylon covering and has a bottom side, and wherein said cushion coupling member extending the entire length of said bottom side.

8. The strap of claim 6, wherein said cushion member is a rectangular cube.

9. The strap of claim 1, wherein said end belt includes a reenforcing member at one end thereof.

10. The strap of claim 1, wherein said band is covered with a covering material.

11. The strap of claim 1, wherein said belt coupling member connected to said end belt is a hook and pile fastener extending approximately one-half the length of said end belt.

12. The strap of claim 1, wherein said bottom anchor member, cushion coupling member, belt coupling member, and end anchor member comprise hook and pile fasteners.

* * * * *